US008781704B2

(12) United States Patent
Mitake et al.

(10) Patent No.: US 8,781,704 B2
(45) Date of Patent: Jul. 15, 2014

(54) TRAVELING ASSISTANT SYSTEM FOR VEHICLES WITHOUT CONTACT WIRE

(75) Inventors: Masaya Mitake, Minato-ku (JP); Takayuki Kono, Minato-ku (JP); Katsuaki Morita, Minato-ku (JP); Takeya Kawamura, Minato-ku (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 148 days.

(21) Appl. No.: 13/383,664

(22) PCT Filed: Aug. 24, 2010

(86) PCT No.: PCT/JP2010/064209

§ 371 (c)(1),
(2), (4) Date: Jan. 12, 2012

(87) PCT Pub. No.: WO2011/074288

PCT Pub. Date: Jun. 23, 2011

(65) Prior Publication Data

US 2012/0116642 A1 May 10, 2012

(30) Foreign Application Priority Data

Dec. 17, 2009 (JP) ..... 2009-286088

(51) Int. Cl.
*B60T 8/32* (2006.01)

(52) U.S. Cl.
USPC ..... 701/93; 701/25; 701/30.2; 701/79; 180/170

(58) Field of Classification Search
USPC ..... 701/25, 30.2, 79, 93, 96; 180/170; 340/439, 479, 903
See application file for complete search history.

(56) References Cited

U.S. PATENT DOCUMENTS 5,521,580 A * 5/1996 Kaneko et al. ..... 340/439
6,067,031 A * 5/2000 Janky et al. ..... 340/903
6,137,531 A * 10/2000 Kanzaki et al. ..... 348/149

(Continued)

FOREIGN PATENT DOCUMENTS

CN 1862227 11/2006
CN 101038700 9/2007

(Continued)

OTHER PUBLICATIONS

International Search Report issued Sep. 21, 2010 in International (PCT) Application No. PCT/JP2010/064209.
International Preliminary Report on Patentability and Written Opinion of the International Searching Authority issued Jul. 19, 2012 in International (PCT) Application No. PCT/JP2010/064209.

(Continued)

*Primary Examiner* — Gertrude Arthur Jeanglaude
(74) *Attorney, Agent, or Firm* — Wenderoth, Lind & Ponack, L.L.P.

(57) ABSTRACT

A memory stores traveling schedule information of a vehicle without a contact wire, information on a next station located on a traveling interval and information about a plurality of traffic lights on the traveling interval temporarily, and a velocity pattern calculator for calculating a velocity pattern of the vehicle based on the traveling schedule information, the information on the next station and the information about the plurality of the traffic lights, in which the velocity pattern calculator calculates a velocity pattern which satisfies conditions that the vehicle is never stopped at a first traffic light, that when the vehicle departs from a current stop station, the vehicle is accelerated at an constant acceleration a and that after the acceleration, the vehicle travels at a constant first velocity $V_1$.

20 Claims, 5 Drawing Sheets

(56) References Cited

U.S. PATENT DOCUMENTS

| | | | | |
|---|---|---|---|---|
| 6,175,305 | B1 * | 1/2001 | Johnson et al. | 340/479 |
| 6,618,000 | B2 * | 9/2003 | Winner et al. | 342/71 |
| 6,805,216 | B2 * | 10/2004 | Noecker | 180/170 |

FOREIGN PATENT DOCUMENTS

| | | |
|---|---|---|
| CN | 101414410 | 4/2009 |
| JP | 2003-226241 | 8/2003 |
| JP | 2006-6030 | 1/2006 |
| JP | 2006-44492 | 2/2006 |

OTHER PUBLICATIONS

Korean Notice of Allowance issued Nov. 5, 2013 in corresponding Korean Patent Application No. 10-2012-7002566 with concise explanation.

Japanese Official Notice of Allowance dispatched Nov. 15, 2013 in corresponding Japanese Patent Application No. 2009-286088 with English translation.

Chinese Office Action issued Nov. 13, 2013 in corresponding Chinese Patent Application No. 201080033988.1 with English translation.

* cited by examiner

TRAVELING ASSISTANT SYSTEM FOR VEHICLES WITHOUT CONTACT WIRE

This application is a U.S. National Stage Application of International (PCT) Application No. PCT/JP2010/064209, filed Aug. 24, 2010.

TECHNICAL FIELD

The present invention relates to a traveling assistant system for a vehicle without a contact wire. More particularly, it relates to a traveling assistant system for calculating a velocity pattern in a traveling interval from a current stop station to a next station.

BACKGROUND ART

Conventionally, traffic vehicles such as a vehicle without a contact wire are controlled by a traffic light system which controls traveling of vehicles such as automobiles. Thus, operators of traffic vehicles operate the vehicles to advance or stop the vehicles following an indication by traffic lights.

Under such a traffic light system, the traffic vehicle is stopped and restarted repeatedly, and consequently, there is a possibility that the traffic vehicle may be unable to travel according to a regular traveling schedule, thereby providing users with inconvenience. Patent Literature 1 has disclosed a traveling assistant system for calculating a velocity pattern which enables the traffic vehicle to travel according to the regular traveling schedule by minimizing the stopping and restarting.

PRIOR ART DOCUMENT

Patent Literature

Patent Literature 1: Japanese Unexamined Patent Application Publication No. 2006-44492

SUMMARY OF THE INVENTION

Problem to be Solved by the Invention

However, the velocity pattern calculated by the aforementioned Patent Literature 1 includes a large number of acceleration and deceleration intervals and a small number of constant-velocity intervals. Thus, there is such a problem that the energy efficiency of the traffic vehicle is low.

The present invention has been accomplished in view of such a circumstance and an object of the invention is to provide a traveling assistant system for a vehicle without a contact wire capable of calculating the velocity pattern which enables improvement of the energy efficiency of the vehicle without the contact wire.

Means for Solving the Problem

To solve the problem of the above-described conventional technology, the present invention provides a traveling assistant system for a vehicle without a contact wire, the traveling assistant system being configured to calculate a velocity pattern in a traveling interval from a current stop station to a next station. The traveling assistant system includes a memory means which previously stores traveling schedule information of the vehicle, information on the next station located on the traveling interval, and information about a plurality of traffic lights on the traveling interval; and a velocity pattern calculation means which calculates a velocity pattern of the vehicle based on the traveling schedule information, the information on the next station, and the information about the plurality of the traffic lights, in which when calculating the velocity pattern in an interval from the current stop station to a first traffic light of the plurality of traffic lights, the velocity pattern calculation means calculates a velocity pattern which satisfies conditions that the vehicle is never stopped at the first traffic light, that the vehicle accelerates at an constant acceleration when the vehicle departs from the current stop station, and that after the acceleration, the vehicle travels at a constant first velocity, and in which the first velocity is calculated based on a traveling time taken from the current stop station to the first traffic light when the vehicle travels at a maximum velocity, a traveling time taken from the current stop station to the first traffic light calculated considering the traveling schedule information, a traveling distance from the current stop station to the first traffic light, information on the first traffic light, and the constant acceleration.

According to the present invention, assuming that the vehicle travels at a maximum velocity, the velocity pattern calculation means determines whether or not the vehicle is stopped at the first traffic light, in which when it is determined that the vehicle is stopped at the first traffic light, the first velocity is calculated based on the following first relational expression and third relational expression, and in which when it is determined that the vehicle can pass without being stopped at the first traffic light, the first velocity is calculated based on the following second relational expression and third relational expression, $$t_w=(t_{target}-t_s)+t_{m1} \quad \text{First relational expression}$$

$$t_w=(t_{limit}-t_s)+t_{m1} \quad \text{Second relational expression}$$

$$t_w=L_w/V_1+V_1/2a, \quad \text{Third relational expression}$$

where $V_1$ is the first velocity, a is constant acceleration, $t_w$ is a traveling time taken from the current stop station to the first traffic light, $t_s$ is a departure time from the current stop station, $t_{target}$ is a time when the first traffic light changes from red to green the next time, $t_{limit}$ is a time when the first traffic light changes from green to red the next time, $t_{m1}$ is a margin for the traveling time $t_x$, and $L_w$ is a traveling distance from the current stop station to the first traffic light.

Furthermore, according to the present invention, when calculating a velocity pattern in an interval between the first traffic light and a second traffic light located next of the plurality of traffic lights, the velocity pattern calculation means calculates a velocity pattern which satisfies conditions that the vehicle is never stopped at the second traffic light, that the vehicle is accelerated or decelerated at an constant acceleration after the vehicle passes the first traffic light, that the acceleration and deceleration at the constant acceleration are limited to a single time or less, and that the vehicle travels at a constant second velocity after the acceleration or the deceleration, and the second velocity is calculated based on a traveling time taken from the first traffic light to the second traffic light when the vehicle travels at a maximum velocity, a traveling time taken from the first traffic light to the second traffic light calculated considering the traveling schedule information, a traveling distance from the first traffic light to the second traffic light, information on the second traffic light, and the constant acceleration.

According to the present invention, assuming that the vehicle travels at the maximum velocity, the velocity pattern calculation means determines whether or not the vehicle is stopped at the second traffic light, in which when it is determined that the vehicle is stopped at the second traffic light, the second velocity is calculated based on the following fourth relational expression and sixth relational expression, and in which when it is determined that the vehicle can pass the second traffic light without being stopped at the second traffic light, the second velocity is calculated based on the following fifth relational expression and sixth relational expression, $$t_x=(t_{target}-t_{g1})+t_{m2} \quad \text{Fourth relational expression}$$

$$t_x=(t_{limit}-t_{g1})+t_{m2} \quad \text{Fifth relational expression}$$

$$t_x=L_x/V_2+(V_2-V_o)^2/2aV_2, \quad \text{Sixth relational expression}$$

where $V_2$ is the second velocity, a is constant acceleration, $V_o$ is a velocity when the vehicle passes the first traffic light, $t_x$ is a traveling time taken from the first traffic light to the second traffic light, $t_{g1}$ is a time when the vehicle passes the first traffic light, $t_{target}$ is a time when the second traffic light changes from red to green at next time, $t_{limit}$ is a time when the second traffic light changes from green to red at next time, $t_{m2}$ is a margin for the traveling time $t_x$, and $L_x$ is a traveling distance from the first traffic light to the second traffic light.

According to the present invention, when calculating a velocity pattern in an interval between the last traffic light of the plurality of traffic lights and the next station, the velocity pattern calculation means calculates a velocity pattern which satisfies conditions that the vehicle is decelerated at an constant acceleration before the vehicle arrives at the next station, and that before decelerating, the vehicle travels constantly at a third velocity when the vehicle passes the last traffic light, and the third velocity is calculated based on a traveling time taken from the last traffic light to the next station calculated considering the traveling schedule information, a traveling distance from the last traffic light to the next station, and the constant acceleration.

According to the present invention, the third velocity is calculated based on the following seventh relational expression and eighth relational expression, $$t_y=(t_g-t_{g2})+t_{m3} \quad \text{Seventh relational expression}$$

$$t_y=L_y/V_3+V_3/2a, \quad \text{Eighth relational expression}$$

where $V_3$ is the third velocity, a is constant acceleration, $t_y$ is a traveling time taken from the last traffic light to the next station, $t_g$ is an arrival time at the next station, $t_{g2}$ is a time when the vehicle passes the last traffic light, $t_{m3}$ is a margin for the traveling time $t_y$, and $L_y$ is a traveling distance from the last traffic light to the next station.

According to the present invention, the traveling assistant system further includes a detection means which detects a position and velocity of the vehicle traveling currently, and the velocity pattern calculation means is configured to correct the first to third velocities based on a current position and the velocity of the vehicle detected by the detection means.

Furthermore, the present invention provides a traveling assistant system for a vehicle without a contact wire, the traveling assistant system being configured to calculate a velocity pattern in a traveling interval from a current stop station to a next station. The traveling assistant system includes a memory means which previously stores traveling schedule information of the vehicle and information on a next station located on the traveling interval; and a velocity pattern calculation means which calculates a velocity pattern of the vehicle based on the traveling schedule information and the information on the next station, in which when calculating a velocity pattern in an interval between the current stop station and the next station, the velocity pattern calculation means calculates a velocity pattern which satisfies conditions that when the vehicle departs from the current stop station and when the vehicle arrives at the next station, the vehicle is accelerated or decelerated at an constant acceleration, and that the vehicle travels at a constant fourth velocity between acceleration and deceleration, and in which the fourth velocity is calculated based on a traveling time taken from the current stop station to the next station calculated considering the traveling schedule information, a traveling distance from the current stop station to the next station, and the constant acceleration.

Still further, according to the present invention, the fourth velocity is calculated based on the following ninth relational expression and tenth relational expression, $$t_z=(t_g-t_s)+t_{m4} \quad \text{Ninth relational expression}$$

$$t_z=L_z/V_4+V_4/a, \quad \text{Tenth relational expression}$$

where $V_4$ is the fourth velocity, a is constant acceleration, $t_z$ is a traveling time taken from the current stop station to the next station, $t_g$ is an arrival time at the next station, $t_s$ is a departure time from the current stop station, $t_{m4}$ is a margin for the traveling time $t_z$, and $L_z$ is a traveling distance from the current stop station to the next station.

According to the present invention, the traveling assistant system further includes a detection means which detects a position and velocity of the vehicle traveling currently, in which the velocity pattern calculation means is configured to correct the fourth velocity based on a current position and the velocity of the vehicle detected by the detection means.

Effect of the Invention

According to the traveling assistant system for the vehicle without the contact wire of the present invention, the acceleration and deceleration of the vehicle without the contact wire are limited to a single time or less in an interval between the current stop station and the first traffic light, an interval between the first traffic light of the multiple traffic lights and the second traffic light located next, and an interval between the last traffic light and the next station. As a result, energy consumption due to acceleration or deceleration can be suppressed. Furthermore, because a velocity pattern in which the constant velocity interval follows the acceleration or deceleration interval is calculated, the energy efficiency of the vehicle without the contact wire can be improved over a conventional case.

In addition, according to the traveling assistant system for the vehicle without the contact wire of the present invention, when no traffic light exists between the current stop station and the next station, a velocity pattern in which the acceleration and deceleration are implemented one time each and that after the acceleration, the vehicle travels at the constant velocity is calculated. Consequently, the energy efficiency of the vehicle without the contact wire can be improved as compared to a conventional case.

Furthermore, according to the traveling assistant system for the vehicle without the contact wire of the present invention, the velocity pattern calculation means acquires a current position and velocity of the vehicle without the contact wire from the detection means and corrects the velocity pattern of the vehicle without the contact wire. Consequently, even when delay or the like occurs in the vehicle without the contact wire due to a variety of conditions such as traffic jamming, the vehicle can be operated regularly according to the traveling schedule by correcting the velocity pattern.

DESCRIPTION OF EMBODIMENTS

Figure 1:
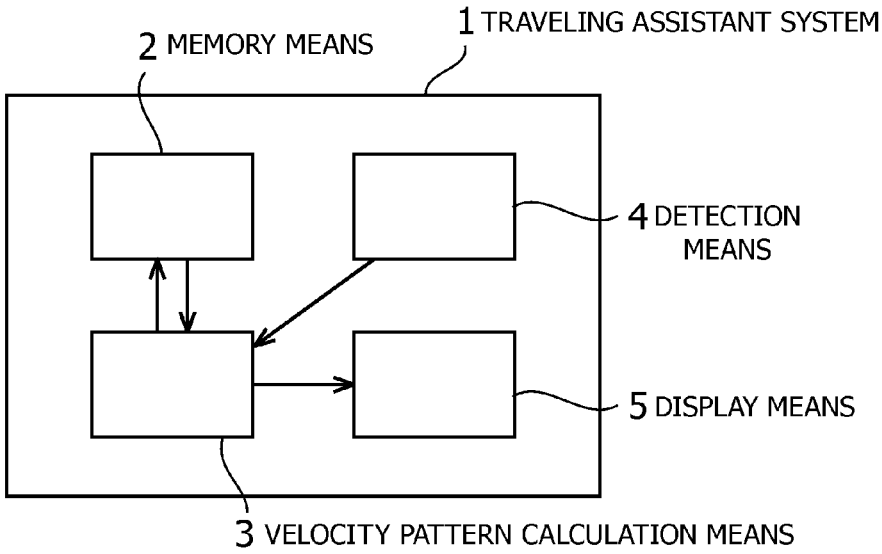
FIG. 1 is a diagram showing the configuration of a traveling assistant system for a vehicle without a contact wire according to an embodiment of the present invention.

Hereinafter, a traveling assistant system for a vehicle without a contact wire according to an embodiment of the present invention will be described with reference to the accompanying drawings. FIG. 1 is a diagram showing the configuration of the traveling assistant system for the vehicle without the contact wire according to the embodiment of the present invention.

The traveling assistant system 1 shown in FIG. 1 is mounted on a vehicle without a contact wire (not shown) and configured to calculate a velocity pattern in a traveling interval from a current stop station to a next station.

As shown in FIG. 1, the traveling assistant system 1 includes a memory means 2, a velocity pattern calculation means 3, a detection means 4, and a display means 5. The memory means 2 previously stores traveling schedule information of the vehicle without the contact wire, information on a next station located on a traveling interval and information about a plurality of traffic lights installed on the traveling interval. The velocity pattern calculation means 3 calculates a velocity pattern of the vehicle without the contact wire based on the traveling schedule information, the information on the next station and the information about the plurality of the traffic lights. In addition, the detection means 4 detects a position and a velocity of the vehicle traveling currently. Furthermore, the display means 5 displays the velocity pattern.

The aforementioned traveling schedule information includes information on time table of the vehicle without the contact wire, for example, information on a departure time from a current stop station and information on an arrival time at a next station. The information on the next station includes position information of the next station and information on a distance up to the next station. Furthermore, the information on the traffic lights includes position information on traffic lights located on a traveling interval and information on a distance between respective traffic lights and a time when the traffic light changes from red to green and from green to red.

As shown in FIG. 1, the velocity pattern calculation means 3 is connected to the memory means 2, and the velocity pattern calculation means 3 acquires the traveling schedule information, the information on the next station and the information on the plurality of the traffic lights to calculate the velocity pattern of the vehicle without the contact wire. The velocity pattern calculated by the velocity pattern calculation means 3 is sent to the display means 5. An operator of the vehicle without the contact wire operates the vehicle without the contact wire according to the velocity pattern displayed on the display means 5.

Velocity Pattern in an Interval from a Current Stop Station to a First Traffic Light Hereinafter, a method for calculating a velocity pattern in an interval from a current stop station to a first traffic light of multiple traffic lights using the traveling assistant system according to the embodiment of the present invention will be described with reference to accompanying drawings.

Figure 2:
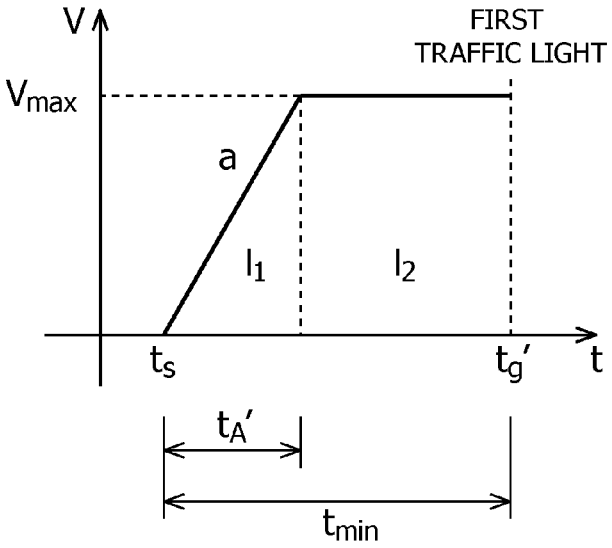
FIG. 2 is a diagram showing a relationship between a time t to be taken when a vehicle travels from a current stop station to a first traffic light of multiple traffic lights and a velocity V.
Figure 3:
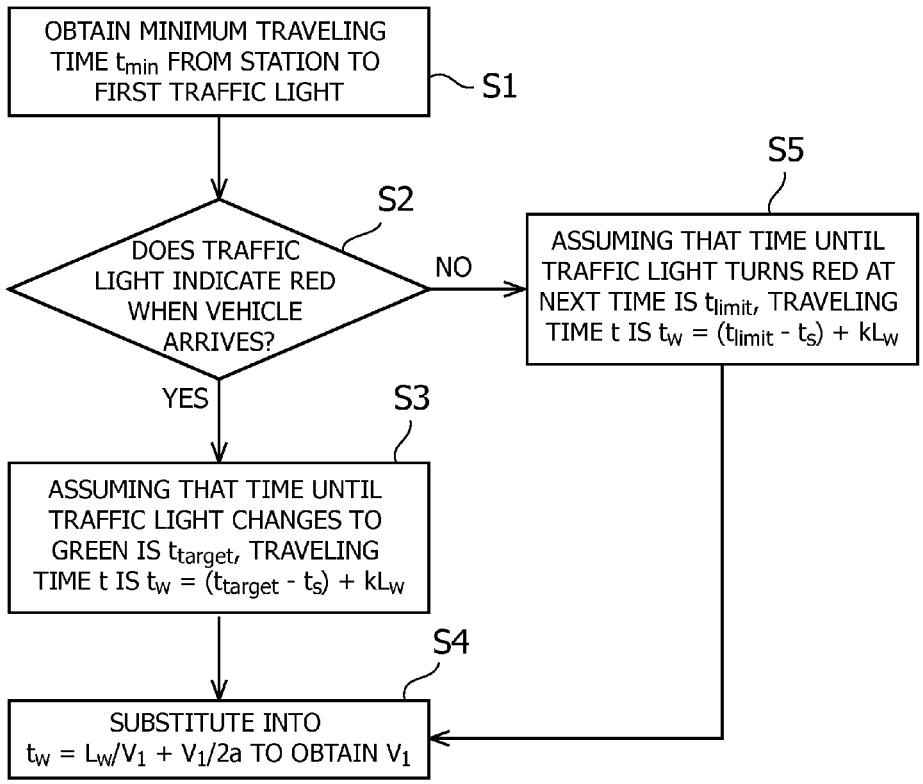
FIG. 3 is a flow chart for calculation of a velocity pattern in an interval between a current stop station and the first traffic light.

FIG. 2 is a diagram showing a relationship between a time t taken when the vehicle travels from a current stop station to the first traffic light of the multiple traffic lights and a velocity V. FIG. 3 is a flow chart for calculation of a velocity pattern in an interval between the current stop station and the first traffic light.

When calculating the velocity pattern in an interval from the current stop station to the first traffic light of the multiple traffic lights, the velocity pattern calculation means 3 calculates a velocity pattern which satisfies conditions that the vehicle without the contact wire is never stopped at the first traffic light, that the vehicle is accelerated at an constant acceleration "a" when it departs from the current stop station and that the vehicle without the contact wire travels at a constant first velocity $V_1$.

A calculation method for the first velocity $V_1$ will be described with reference to FIG. 2. Assume that a traveling time taken from the current stop station to the first traffic light is $t_w$. Here, assume that a margin allowable to this traveling time $t_w$ is $t_{m1}$. When a departure time from the current stop station is $t_s$ and an arrival time at the first traffic light is $t_g'$, the traveling time $t_w$ can be expressed as follows.

$$t_w=(t_g'-t_s)+t_{m1} \quad \text{(Equation 1)}$$

Because the margin $t_{m1}$ is considered proportional to the distance from the current stop station to the first traffic light, the equation 1 can be expressed as follows.

$$t_w=(t_g'-t_s)+kL_w \quad \text{(Equation 2)}$$

where $L_w$ is a traveling distance from the current stop station to the first traffic light and k is a proportionality coefficient.

When calculating the first velocity $V_1$, first, a minimum traveling time $t_{min}$ taken from the current stop station to the first traffic light is introduced. The minimum traveling time $t_{min}$ is a traveling time taken when the vehicle travels at a maximum velocity $V_{max}$ ($V_{max}>V_1$) in terms of the vehicle performance. Therefore, as shown in FIG. 2, a traveling distance $I_1$ in an acceleration interval and a traveling distance $I_2$ in a constant velocity interval are as follows.

$$I_1=V_{max}t_A'/2 \quad \text{(Equation 3)}$$

$$I_2=V_{max}(t_{min}-t_A') \quad \text{(Equation 4)}$$

where $t_A'$ is a time taken until the velocity increases to the maximum velocity $V_{max}$ from 0.

Next, a traveling distance $L_w$ from the current stop station to the first traffic light is as follows, using the traveling distance $I_1$ in the acceleration interval and the traveling distance $I_2$ in the constant velocity interval.

$$L_w=I_1+I_2=V_{max}t_A'/2+V_{max}(t_{min}-t_A')=V_{max}t_{min}-V_{max}t_A'/2 \quad \text{(Equation 5)}$$

Using a relationship of $V_{max}=at_A'$, the equation 5 is as follows.

$$t_{min}=L_w/V_{max}+V_{max}/2a \quad \text{(Equation 6)}$$

$L_w$ can be input by using the aforementioned information about the traffic light, and $V_{max}$ and the acceleration "a" can be known preliminarily from the vehicle performance.

A relational expression between the first velocity $V_1$ and the traveling time $t_w$ from the current stop station to the first traffic light can be obtained by replacing $V_{max}$ of the equation 6 with $V_1$ and replacing $t_{min}$ with $t_w$.

$$t_w=L_w/V_1+V_1/2a \quad \text{(Equation 7)}$$

Next, a flow for calculation of the first velocity $V_1$ will be described with reference to FIG. 3.

As shown in FIG. 3, in step S1, the minimum traveling time $t_{min}$ is obtained using the equation 6.

Next, in step S2, when the vehicle arrives at the first traffic light in the minimum traveling time $t_{min}$ after it departs from the current stop station at a departure time $t_s$, whether or not the first traffic light indicates red (stop) is determined. Upon this determination, the information of the traffic light described above is used.

Then, when the first traffic light indicates red, in step S3, a time $t_{target}$ when the first traffic light turns from red to green is substituted into $t_g'$ in the equation 2. The equation 2 is transformed as follows.

$$t_w=(t_{target}-t_s)+kL_w \quad \text{(Equation 8)}$$

Finally, in step S4, $t_w$ obtained from a relationship with the equation 8 is substituted into equation 7 to obtain the first velocity $V_1$.

On the other hand, when the first traffic light does not indicate red (that is, indicates green), in step S5, a time $_{limit}$ when the first traffic light changes from green to red the next time is substituted into $t_g'$ in the equation 2. The equation 2 is transformed as follows.

$$t_w=(t_{limit}-t_s)+kL_w \quad \text{(Equation 9)}$$

Finally, in step S4, $t_w$ obtained by a relationship with the equation 9 is substituted into the equation 7 to obtain the first velocity $V_1$. In the meantime, $t_{target}$ and $t_{limit}$ can be input by using the aforementioned information on the traffic light and $t_s$ can be input by using the aforementioned traveling schedule information.

By the steps above, the first velocity $V_1$ can be obtained.

Velocity Pattern in an Interval Between the First Traffic Light of the Multiple Traffic Lights and a Second Traffic Light Located Next Hereinafter, a method for calculating a velocity pattern in an interval between the first traffic light of the multiple traffic lights and a second traffic light located next using the traveling assistant system according to the embodiment of the present invention will be described with reference to drawings.

Figure 4:
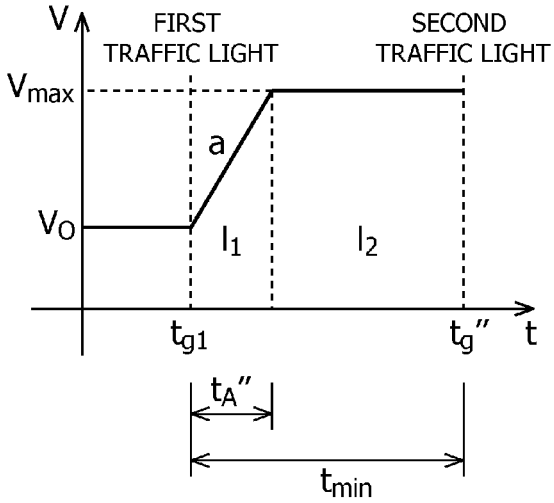
FIG. 4 is a diagram showing a relationship between a time t taken when the vehicle travels from the first traffic light to a second traffic light located next and a velocity V.
Figure 5:
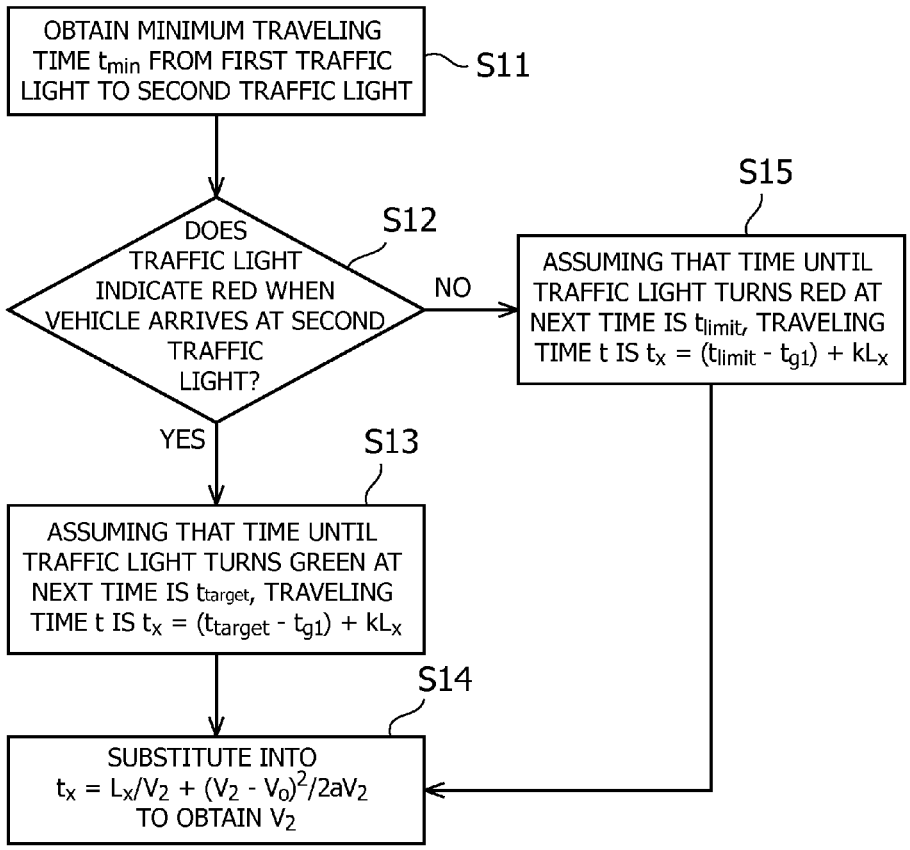
FIG. 5 is a flow chart for calculation of a velocity pattern in an interval between the first traffic light and the second traffic light located next.

FIG. 4 is a diagram showing a relationship between a time t taken when the vehicle travels from the first traffic light to a second traffic light located next and a velocity V. FIG. 5 is a flow chart for calculation of a velocity pattern in an interval between the first traffic light and the second traffic light located next.

When calculating a velocity pattern in an interval between the first traffic light of the multiple traffic lights and the second traffic light located next, the velocity pattern calculation means 3 calculates such a velocity pattern which satisfies conditions that the vehicle without the contact wire is never stopped at the second traffic light, that the vehicle is accelerated or decelerated at an constant acceleration "a" after it passes the first traffic light, that the acceleration and deceleration at the constant acceleration a are limited to a single time or less, and that the vehicle without the contact wire travels at a constant second velocity $V_2$ after the acceleration or deceleration.

The calculation method for the second velocity $V_2$ will be described with reference to FIG. 4.

Assume that a traveling time from the first traffic light to the second traffic light located next is $t_x$. Here, assume that a margin allowable to this traveling time $t_x$ is $t_{m2}$. Assuming that a time when the vehicle passes the first traffic light is $t_{g1}$ and an arrival time at the second traffic light is $t_g''$, the traveling time $t_x$ can be expressed as follows.

$$t_x=(t_g''-t_{g1})+t_{m2} \quad \text{(Equation 10)}$$

Because the margin $t_{m2}$ is considered proportional to a distance from the first traffic light to the second traffic light, the equation 10 can be expressed as follows.

$$t_x=(t_g''-t_{g1})+kL_x \quad \text{(Equation 11)}$$

where $L_x$ is a traveling distance from the first traffic light to the second traffic light and k is a proportionality coefficient.

When calculating the second velocity $V_2$, first, a minimum traveling time $t_{min}$ taken from the first traffic light to the second traffic light is introduced. The minimum traveling time $t_{min}$ is a traveling time taken when the vehicle travels at a maximum velocity $V_{max}$ ($V_{max}>V_2$) in terms of the vehicle performance. When assuming that a velocity when the vehicle passes the first traffic light is $V_o$ as shown in FIG. 4, a traveling distance $I_1$ in an acceleration interval and a traveling distance $I_2$ in a constant velocity interval are as follows.

$$I_1=V_o t_A''+(V_{max}-V_o)t_A''/2 \quad \text{(Equation 12)}$$

$$I_2=V_{max}(t_{min}-t_A'') \quad \text{(Equation 13)}$$

where $t_A''$ is a time taken until the velocity $V_o$ increases to the maximum velocity $V_{max}$.

Next, a traveling distance $L_x$ from the first traffic light to the second traffic light is as follows, using the traveling distance $I_1$ in the acceleration interval and the traveling distance $I_2$ in the constant velocity interval.

$$L_x=I_1+I_2=V_o t_A''+(V_{max}-V_o)t_A''/2+V_{max}(t_{min}-t_A'')=V_{max}t_{min}-(V_{max}-V_o)t_A''/2 \quad \text{(Equation 14)}$$

Using a relationship of $V_o+at_A''$, the equation 14 is transformed as follows.

$$t_{min}=L_x/V_{max}+(V_{max}-V_o)^2/2aV_{max} \quad \text{(Equation 15)}$$

A relational expression between the second velocity $V_2$ and the traveling time $t_x$ from the first traffic light to the second traffic light can be obtained by replacing $V_{max}$ of the equation 15 with $V_2$ and replacing $t_{min}$ with $t_x$.

$$t_x=L_x/V_2+(V_2-V_o)^2/2aV_2 \quad \text{(Equation 16)}$$

Next, a flow for calculation of the second velocity $V_2$ will be described with reference to FIG. 5. As shown in FIG. 3, in step S11, $t_{min}$ is obtained using the equation 15.

Next, in step S12, when the vehicle arrives at the second traffic light in the minimum traveling time $t_{min}$ after it passes the first traffic light at the time $t_{g1}$, whether or not the second traffic light indicates red (stop) is determined.

Then, when the second traffic light indicates red, in step S13, a time $t_{target}$ when the second traffic light turns from red to green is substituted into $t_g''$ in the equation 11. The equation 11 is transformed as follows.

$$t_x=(t_{target}-t_{g1})+kL_x \quad \text{(Equation 17)}$$

Finally, in step S14, $t_x$ obtained from a relationship with the equation 17 is substituted into equation 16 to obtain the second velocity $V_2$.

On the other hand, when the second traffic light does not indicate red (that is, indicates green), in step S15, a time $_{limit}$ when the second traffic light changes from green to red the next time is substituted into $t_g''$ in the equation 11.

The equation 11 is transformed as follows.

$$t_x=(t_{limit}-t_{s1})+kL_x \quad \text{(Equation 18)}$$

Finally, in step S14, $t_x$ obtained by a relationship with the equation 18 is substituted into the equation 16 to obtain the second velocity $V_2$.

By the steps above, the second velocity $V_2$ can be obtained.

Velocity Pattern in an Interval Between the Last Traffic Light of the Multiple Traffic Lights and a Next Station Hereinafter, a method for calculating a velocity pattern in an interval between a last traffic light of the multiple traffic lights and a next station using the traveling assistant system 1 according to the embodiment of the present invention will be described with reference to drawings.

Figure 6:
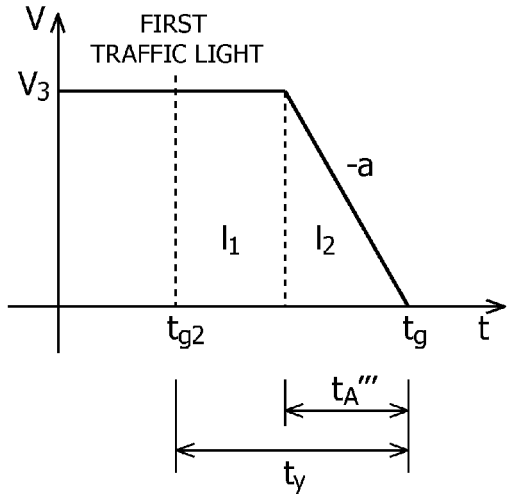
FIG. 6 is a diagram showing a relationship between a time t when the vehicle travels from a last traffic light to a next station and a velocity V.

FIG. 6 is a diagram showing a relationship between a time t taken when the vehicle travels from the last traffic light to a next station and a velocity V.

When calculating a velocity pattern in an interval between the last traffic light of the multiple traffic lights and the next station, the velocity pattern calculation means 3 calculates a velocity pattern which satisfies conditions that the vehicle is decelerated at an constant acceleration "a" before it arrives at the next station and that before decelerating, the vehicle without the contact wire travels constantly at a third velocity $V_3$ when it passes the last traffic light.

The calculation method for the third velocity $V_3$ will be described with reference to FIG. 6.

Assume that a traveling time from the last traffic light to the next station is $t_y$. Here, assume that a margin allowable to this traveling time $t_y$ is $t_{m3}$. Assuming that a time when the vehicle passes the last traffic light is $t_{g2}$ and an arrival time at the next station is $t_g$, the traveling time $t_y$ can be expressed as follows.

$$t_y=(t_g-t_{g2})+t_{m3} \quad \text{(Equation 19)}$$

Because the margin $t_{m3}$ is considered proportional to a distance from the last traffic light to the next station, the equation 19 can be expressed as follows.

$$t_y=(t_g-t_{g2})+kL_y \quad \text{(Equation 20)}$$

where $L_y$ is a traveling distance from the last traffic light to the next station and k is a proportionality coefficient.

As shown in FIG. 6, a traveling distance $I_1$ in a constant velocity interval and a traveling distance $I_2$ in a deceleration interval are as follows.

$$I_1=V_3(t_y-t_A''') \quad \text{(Equation 21)}$$

$$I_2=V_3t_A'''/2 \quad \text{(Equation 22)}$$

where $t_A'''$ is a time taken until the velocity changes from $V_3$ to 0.

Next, a traveling distance $L_y$ from the last traffic light to the next station is as follows, using the traveling distance $I_1$ in the constant velocity interval and the traveling distance $I_2$ in the deceleration interval.

$$L_y=I_1+I_2=V_3(t_y-t_A''')+V_3t_A'''/2=V_3t_y-V_3t_A'''/2 \quad \text{(Equation 23)}$$

Using a relationship of $at_A'''$, the equation 23 is transformed as follows.

$$t_y=L_y/V_3+V_3/2a \quad \text{(Equation 23)}$$

As a result, the third velocity $V_3$ can be obtained from the equation 20 and the equation 24.

Figure 7:
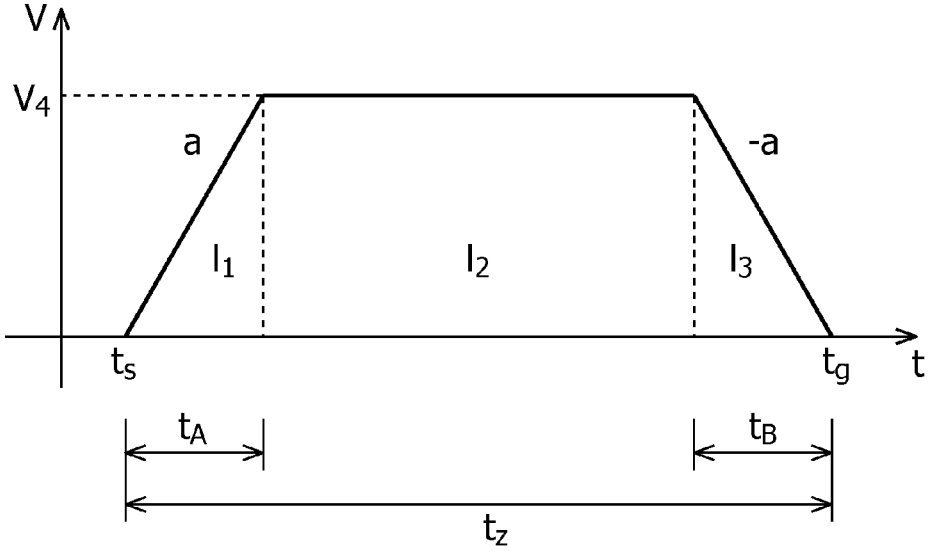
FIG. 7 is a diagram showing a relationship between a time t when the vehicle travels from a current stop station to the next station and a velocity V.

Velocity Pattern in an Interval Between a Current Stop Station and a Next Station Hereinafter, a method for calculating a velocity pattern in an interval between a current stop station and a next station using the traveling assistant system 1 according to the embodiment of the present invention will be described with reference to accompanying drawings. This calculation method may be used for a case in which no traffic light exists between the current stop station and the next station. FIG. 7 is a diagram showing a relationship between a time t when the vehicle travels from the current stop station to the next station and a velocity V.

When calculating the velocity pattern in an interval between the current stop station and the next station, the velocity pattern calculation means 3 calculates such a velocity pattern which satisfies conditions that when the vehicle departs from the current stop station and when the vehicle arrives at the next station, it must be accelerated or decelerated at an constant acceleration "a" and that after the acceleration and before the deceleration, the vehicle without the contact wire travels constantly at a fourth velocity $V_4$.

A calculation method for the fourth velocity $V_4$ will be described with reference to FIG. 7.

Assume that a traveling time taken from the current stop station to the next station is $t_z$. Here, assume that a margin allowable to this traveling time $t_z$ is $t_{m4}$. Assuming that a departure time from the current stop station is $t_s$ and an arrival time at the next station is $t_g$, the traveling time $t_z$ can be expressed as follows.

$$t_z=(t_g-t_s)+t_{m4} \quad \text{(Equation 25)}$$

Because the margin $t_{m4}$ is considered proportional to the distance from the current stop station to the next station, the equation 25 can be expressed as follows.

$$t_z=(t_g-t_s)+kL_z \quad \text{(Equation 26)}$$

where $L_z$ is a traveling distance from the current stop station to the next station and k is a proportionality coefficient.

As shown in FIG. 7, the traveling distance $I_1$ in the acceleration interval, the traveling distance $I_2$ in the constant velocity interval and the traveling distance $I_3$ in the deceleration interval are expressed as follows.

$$I_1=V_4t_A/2 \quad \text{(Equation 27)}$$

$$I_2=V_4(t_z-t_A-t_B) \quad \text{(Equation 28)}$$

$$I_3=V_4t_B/2 \quad \text{(Equation 29)}$$

where $t_A$ is a time taken until the velocity changes from 0 to $V_4$ and $t_B$ is a time taken until the velocity changes from $V_4$ to 0.

Next, a traveling distance $L_z$ from the current stop station to the next station is as follows using a relationship of $t_A=t_B$.

$$L_z=I_1+I_2+I_3=v_4t_A/2+v_4(t_z-t_A-t_B)+v_4t_B/2=v_4t_z-v_4t_A \quad \text{(Equation 30)}$$

Furthermore, the equation 30 is transformed as follows for the reason of $v_4=at_A$.

$$t_z=L_z/v_4+v_4/a \quad \text{(Equation 31)}$$

Thus, the fourth velocity $V_4$ can be obtained from the equation 26 and the equation 31.

Correction of Velocity Pattern During Vehicle Traveling

Hereinafter, a method for correcting the velocity pattern during traveling of the vehicle without the contact wire using the traveling schedule apparatus 1 according to the embodiment of the present invention will be described with reference to drawings.

A case of correcting the velocity pattern in the constant velocity interval when the vehicle without the contact wire travels from the first traffic light to the second traffic light located next will be described as an example.

Figure 8:
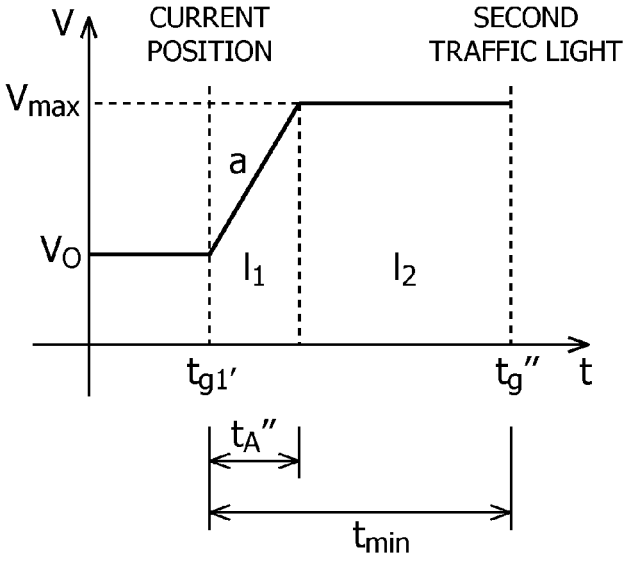
FIG. 8 is a diagram showing a relationship between a time t taken when the vehicle travels from a current position to a second traffic light located next and a velocity V.
Figure 9:
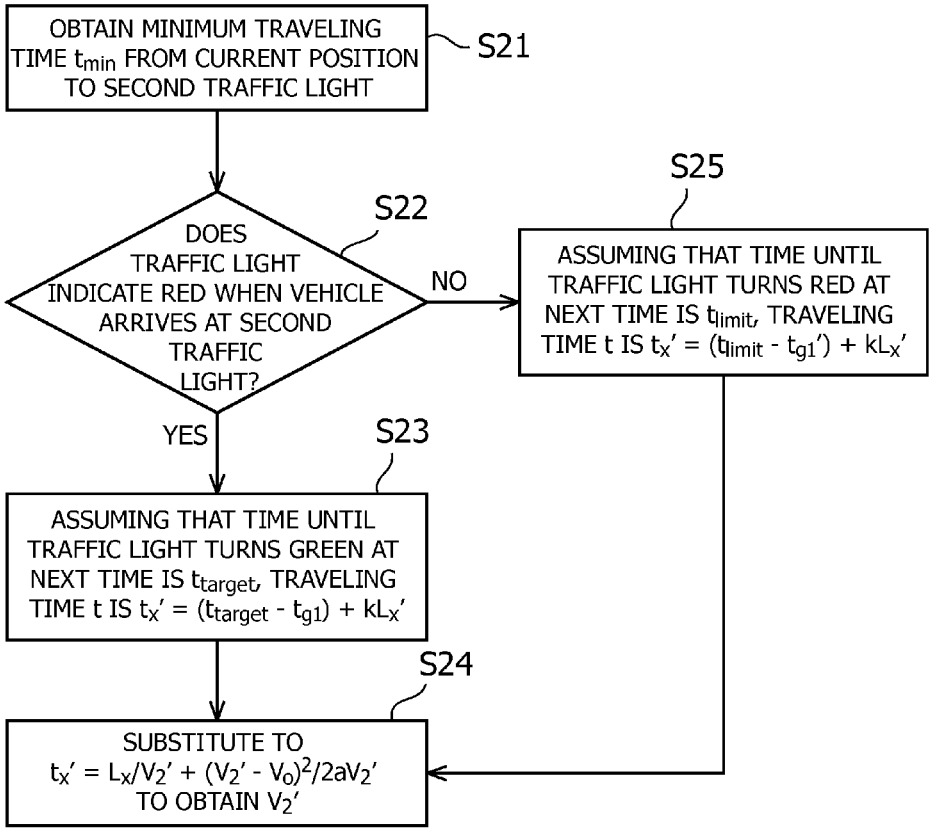
FIG. 9 is a flow chart for calculation of a velocity pattern in an interval between the current position and the second traffic light.

FIG. 8 is a diagram showing a relationship between a time t taken when the vehicle travels from a current position to a second traffic light located next and a velocity V. FIG. 9 is a flow chart for calculation of a velocity pattern in an interval between the current position and the second traffic light.

First, the configuration of the traveling assistant system 1 will be described. As shown in FIG. 1, the velocity pattern calculation means 3 is connected to the detection means 4, and the velocity pattern calculation means 5 acquires a current position and velocity of the traveling vehicle without the contact wire from the detection means 4 to correct the velocity pattern of the vehicle without the contact wire.

Referring to FIG. 8, a calculation method for a second velocity $V_2'$ after the correction will be described.

Assume that a traveling time from a current position to a second traffic light is $t_x'$. Here, assume that a margin allowable to this traveling time $t_x'$ is $t_{m2}'$. When the current time is $t_{g1}'$ and an arrival time at the second traffic light is $t_g''$, the traveling time $t_x'$ can be expressed as follows.

$$t_x'=(t_g''-t_{g1}')+t_{m2}' \quad \text{(Equation 32)}$$

Because the margin $t_{m2}'$ is considered proportional to the distance from the current position to the second traffic light, the equation 32 can be expressed as follows.

$$t_x'=(t_g''-t_{g1}')+kL_x' \quad \text{(Equation 33)}$$

where $L_x'$ is a traveling distance from the current position to the second traffic light and k is a proportionality coefficient.

When calculating the second velocity $V_2'$ after the correction is done, first, a minimum traveling time $t_{min}$ taken from the current position to the second traffic light is introduced. The minimum traveling time $t_{min}$ is a traveling time taken when the vehicle travels at a maximum velocity $V_{max}$ ($V_{max}>V_2'$) in terms of the vehicle performance. Therefore, as shown in FIG. 8, assuming that the current velocity detected by the detection means is $V_o$, a traveling distance $I_1$ in an acceleration interval and a traveling distance $I_2$ in a constant velocity interval are as follows.

$$I_1=V_o t_A''+(V_{max}-V_o)t_A''/2 \quad \text{(Equation 34)}$$

$$I_2=V_{max}(t_{min}-t_A'') \quad \text{(Equation 35)}$$

where $t_A''$ is a time taken until the velocity changes from $V_o$ to the maximum velocity $V_{max}$.

Next, a traveling distance $L_x'$ from the current position to the second traffic light is as follows, using the traveling distance $I_1$ in the acceleration interval and the traveling distance $I_2$ in the constant velocity interval.

$$L_x'=I_1+I_2=V_o t_A''+(V_{max}-V_o)t_A''/2+V_{max}(t_{min}-t_A'')=V_{max}t_{min}-(V_{max}-V_o)t_A''/2 \quad \text{(Equation 36)}$$

Using a relationship of $V_{max}=V_o+at_A''$, the minimum traveling time $t_{min}$ is as follows.

$$t_{min}=L_x''/V_{max}+(V_{max}-V_o)^2/2aV_{max} \quad \text{(Equation 37)}$$

In the meantime, $L_x'$ can be input using the aforementioned information on the traffic light and current position information detected by the detection means 4.

A relational expression between the second velocity $V_2'$ after the correction and the traveling time $t_x'$ from the current position to the second traffic light can be obtained by replacing $V_{max}$ of the equation 37 with $V_2'$ and replacing $t_{min}$ with $t_x'$.

$$t_x'=L_x'/V_2'+(V_2'-V_o)^2/2aV_2' \quad \text{(Equation 38)}$$

Next, a flow for calculation of the second velocity $V_2'$ after the correction will be described with reference to FIG. 9.

As shown in FIG. 9, in step S21, $t_{min}$ is obtained using the equation 37.

Next, in step S22, when the vehicle arrives at the second traffic light in the minimum traveling time $t_{min}$ since a current time $t_{g1}'$, whether or not the second traffic light indicates red (stop) is determined.

If the second traffic light indicates red, in step S23, a time $t_{target}$ when the second traffic light changes from red to green the next time is substituted into $t_g''$ of the equation 33. As a result, the equation 33 transforms as follows.

$$t_x'=(t_{target}-t_{g1}')+kL_x' \quad \text{(Equation 39)}$$

Finally, in step S24, $t_x'$ obtained by a relationship with the equation 39 is substituted into equation 38 to obtain a second velocity $V_2'$ after the correction.

On the other hand, if the second traffic light does not indicate red (that is, when it indicates green), in step S25, a time $t_{limit}$ when the second traffic light changes from green to red the next time is substituted into $t_g''$ of equation 33. Then, the equation 33 transforms as follows.

$$t_x'=(t_{limit}-t_{g1}')+kL_x' \quad \text{(Equation 40)}$$

Finally, in step S24, $t_x'$ obtained from a relationship with equation 40 is substituted into equation 38 to obtain a second velocity $V_2'$ after the correction.

By the steps above, the second velocity $V_2'$ after the correction can be obtained.

When the vehicle without the contact wire travels from the current stop station to the first traffic light, the same method as the calculation method described above may be used to correct the velocity pattern during the constant velocity traveling.

According to the traveling assistant system 1 for the vehicle without the contact wire of this embodiment, the acceleration and deceleration of the vehicle without the contact wire are limited to a single time or less in an interval between the current stop station and the first traffic light, an interval between the first traffic light of the multiple traffic lights and the second traffic light located next and an interval between the last traffic light and the next station. As a result, energy consumption due to acceleration or deceleration can be suppressed. Furthermore, because a velocity pattern in which the constant velocity interval follows the acceleration or deceleration interval is calculated, the energy efficiency of the vehicle without the contact wire can be improved over a conventional case.

In particular, by using a calculation method of the aforementioned velocity pattern, even when a plurality of the traffic lights are provided, a velocity pattern that the acceleration and deceleration are implemented one time each and that the vehicle travels from the current stop station to the next station while it travels at a constant velocity between the acceleration and the deceleration can be calculated as an optimum example. As a result, the energy efficiency of the vehicle without the contact wire is improved further.

Furthermore, according to the traveling assistant system 1 for the vehicle without the contact wire of this embodiment, when no traffic light exists between the current stop station and the next station, a velocity pattern in which the acceleration and deceleration are implemented one time each and after the acceleration, the vehicle travels at the constant velocity is calculated. Consequently, the energy efficiency of the vehicle without the contact wire can be improved over a conventional case.

In the traveling assistant system 1 for the vehicle without the contact wire of this embodiment, the velocity pattern calculation means 3 acquires a current position and velocity of the vehicle from the detection means 4 and corrects the velocity pattern of the vehicle. Consequently, even when a delay or the like occurs in the vehicle due to a variety of conditions such as a traffic jam, the vehicle can be operated regularly according to the traveling schedule by correcting the velocity pattern.

Although the embodiments of the present invention have been described above, the present invention is not restricted to the embodiments described previously, and they may be changed or modified in various ways within the technical concept of the invention.

DESCRIPTION OF REFERENCE NUMERALS

1: traveling assistant system
2: memory means
3: velocity pattern calculation means
4: detection means
5: display means
a: acceleration
$V_1$: first velocity
$V_2$: second velocity
$V_3$: third velocity
$V_4$: fourth velocity
$V_o$: velocity when a vehicle passes a first traffic light
$t_w$: traveling time taken from a current stop station to a first traffic light
$t_x$: traveling time taken from a first traffic light to a second traffic light
$t_y$: traveling time taken from a last traffic light to a next station
$t_z$: traveling time taken from a current stop station to a next station
$t_s$: departure time from a current stop station
$t_{target}$: time when a first traffic light changes from red to green the next time
$t_{limit}$: time when a first traffic light changes from green to red the next time
$t_{m1}$, $t_{m2}$, $t_{m3}$, $t_{m4}$: margin in traveling time
$L_w$: traveling distance from a current stop station to a first traffic light
$L_x$: traveling distance from a first traffic light to a second traffic light
$L_y$: traveling distance from a last traffic light to a next station
$L_z$: traveling distance from a current stop station to a next station
$t_{g1}$: time when a vehicle passes a first traffic light
$t_{g2}$: time when a vehicle passes a last traffic light
$t_g$: arrival time at a next station

The invention claimed is:

1. A traveling assistant system for a vehicle without a contact wire, the traveling assistant system being configured to calculate a velocity pattern in a traveling interval from a current stop station to a next station, the traveling assistant system comprising:

a memory means which previously stores traveling schedule information of the vehicle, information on the next station located on the traveling interval, and information about a plurality of traffic lights on the traveling interval; and a velocity pattern calculation means which calculates a velocity pattern of the vehicle based on the traveling schedule information, the information on the next station, and the information about the plurality of the traffic lights, wherein when calculating the velocity pattern in an interval from the current stop station to a first traffic light of the plurality of traffic lights, the velocity pattern calculation means calculates a velocity pattern which satisfies conditions that the vehicle is never stopped at the first traffic light, that the vehicle accelerates at an constant acceleration when the vehicle departs from the current stop station, and that after the acceleration, the vehicle travels at a constant first velocity, and wherein the first velocity is calculated based on a traveling time taken from the current stop station to the first traffic light when the vehicle travels at a maximum velocity, a traveling time taken from the current stop station to the first traffic light calculated considering the traveling schedule information, a traveling distance from the current stop station to the first traffic light, information on the first traffic light, and the constant acceleration.

2. The traveling assistant system for the vehicle without the contact wire according to claim 1, wherein assuming that the vehicle travels at a maximum velocity, the velocity pattern calculation means determines whether or not the vehicle is stopped at the first traffic light, wherein when it is determined that the vehicle is stopped at the first traffic light, the first velocity is calculated based on the following first relational expression and third relational expression, and wherein when it is determined that the vehicle can pass without being stopped at the first traffic light, the first velocity is calculated based on the following second relational expression and third relational expression, $$t_w=(t_{target}-t_s)+t_{m1} \quad \text{First relational expression}$$

$$t_w=(t_{limit}-t_s)+t_{m1} \quad \text{Second relational expression}$$

$$t_w=L_w/V_1+V_1/2a, \quad \text{Third relational expression}$$

where $V_1$ is the first velocity, a is constant acceleration, $t_w$ is a traveling time taken from the current stop station to the first traffic light, $t_s$ is a departure time from the current stop station, $t_{target}$ is a time when the first traffic light changes from red to green the next time, $t_{limit}$ is a time when the first traffic light changes from green to red the next time, $t_{m1}$ is a margin for the traveling time $t_x$, and $L_w$ is a traveling distance from the current stop station to the first traffic light.

3. The traveling assistant system for the vehicle without the contact wire according to claim 1, wherein when calculating a velocity pattern in an interval between the first traffic light and a second traffic light located next of the plurality of traffic lights, the velocity pattern calculation means calculates a velocity pattern which satisfies conditions that the vehicle is never stopped at the second traffic light, that the vehicle is accelerated or decelerated at an constant acceleration after the vehicle passes the first traffic light, that the acceleration and deceleration at the constant acceleration are limited to a single time or less, and that the vehicle travels at a constant second velocity after the acceleration or the deceleration, and wherein the second velocity is calculated based on a traveling time taken from the first traffic light to the second traffic light when the vehicle travels at a maximum velocity, a traveling time taken from the first traffic light to the second traffic light calculated considering the traveling schedule information, a traveling distance from the first traffic light to the second traffic light, information on the second traffic light, and the constant acceleration.

4. The traveling assistant system for the vehicle without the contact wire according to claim 3, wherein assuming that the vehicle travels at the maximum velocity, the velocity pattern calculation means determines whether or not the vehicle is stopped at the second traffic light, wherein when it is determined that the vehicle is stopped at the second traffic light, the second velocity is calculated based on the following fourth relational expression and sixth relational expression, and wherein when it is determined that the vehicle can pass the second traffic light without being stopped at the second traffic light, the second velocity is calculated based on the following fifth relational expression and sixth relational expression, $$t_x=(t_{target}-t_{g1})+t_{m2} \quad \text{Fourth relational expression}$$

$$t_x=(t_{limit}-t_{g1})+t_{m2} \quad \text{Fifth relational expression}$$

$$t_x=L_x/V_2+(V_2-V_o)^2/2aV_2, \quad \text{Sixth relational expression}$$

where $V_2$ is the second velocity, a is constant acceleration, $V_o$ is a velocity when the vehicle passes the first traffic light, $t_x$ is a traveling time taken from the first traffic light to the second traffic light, $t_{g1}$ is a time when the vehicle passes the first traffic light, $t_{target}$ is a time when the second traffic light changes from red to green the next time, $t_{limit}$ is a time when the second traffic light changes from green to red the next time, $t_{m2}$ is a margin for the traveling time $t_x$, and $L_x$ is a traveling distance from the first traffic light to the second traffic light.

5. The traveling assistant system for the vehicle without the contact wire according to claim 1, wherein when calculating a velocity pattern in an interval between the last traffic light of the plurality of traffic lights and the next station, the velocity pattern calculation means calculates a velocity pattern which satisfies conditions that the vehicle is decelerated at an constant acceleration before the vehicle arrives at the next station, and that before decelerating, the vehicle travels constantly at a third velocity when the vehicle passes the last traffic light, wherein the third velocity is calculated based on a traveling time taken from the last traffic light to the next station calculated considering the traveling schedule information, a traveling distance from the last traffic light to the next station, and the constant acceleration.

6. The traveling assistant system for the vehicle without the contact wire according to claim 5, wherein the third velocity is calculated based on the following seventh relational expression and eighth relational expression, $$t_y=(t_g-t_{g2})+t_{m3} \quad \text{Seventh relational expression}$$

$$t_y=L_y/V_3+V_3/2a, \quad \text{Eighth relational expression}$$

where $V_3$ is the third velocity, a is constant acceleration, $t_y$ is a traveling time taken from the last traffic light to the next station, $t_g$ is an arrival time at the next station, $t_{g2}$ is a time when the vehicle passes the last traffic light, $t_{m3}$ is a margin for the traveling time $t_y$, and $L_y$ is a traveling distance from the last traffic light to the next station.

7. The traveling assistant system for the vehicle without the contact wire according to claim 1, the traveling assistant system further comprising a detection means which detects a position and velocity of the vehicle traveling currently, wherein the velocity pattern calculation means is configured to correct the first to third velocities based on a current position and the velocity of the vehicle detected by the detection means.

8. The traveling assistant system for the vehicle without the contact wire according to claim 7, wherein the fourth velocity is calculated based on the following ninth relational expression and tenth relational expression, $$t_z=(t_g-t_s)+t_{m4} \quad \text{Ninth relational expression}$$

$$t_z=L_z/V_4+V_4/a, \quad \text{Tenth relational expression}$$

where $V_4$ is the fourth velocity, a is constant acceleration, $t_z$ is a traveling time taken from the current stop station to the next station, $t_g$ is an arrival time at the next station, $t_s$ is a departure time from the current stop station, $t_{m4}$ is a margin for the traveling time $t_z$, and $L_z$ is a traveling distance from the current stop station to the next station.

9. The traveling schedule system for the vehicle without the contact wire according to claim 1, further comprising a detection means which detects a position and velocity of the vehicle traveling currently, wherein the velocity pattern calculation means is configured to correct the fourth velocity based on a current position and the velocity of the vehicle detected by the detection means.

10. The traveling assistant system for the vehicle without the contact wire according to claim 2, wherein when calculating a velocity pattern in an interval between the first traffic light and a second traffic light located next of the plurality of traffic lights, the velocity pattern calculation means calculates a velocity pattern which satisfies conditions that the vehicle is never stopped at the second traffic light, that the vehicle is accelerated or decelerated at an constant acceleration after the vehicle passes the first traffic light, that the acceleration and deceleration at the constant acceleration are limited to a single time or less, and that the vehicle travels at a constant second velocity after the acceleration or the deceleration, and wherein the second velocity is calculated based on a traveling time taken from the first traffic light to the second traffic light when the vehicle travels at a maximum velocity, a traveling time taken from the first traffic light to the second traffic light calculated considering the traveling schedule information, a traveling distance from the first traffic light to the second traffic light, information on the second traffic light, and the constant acceleration.

11. The traveling assistant system for the vehicle without the contact wire according to claim 10, wherein assuming that the vehicle travels at the maximum velocity, the velocity pattern calculation means determines whether or not the vehicle is stopped at the second traffic light, wherein when it is determined that the vehicle is stopped at the second traffic light, the second velocity is calculated based on the following fourth relational expression and sixth relational expression, and wherein when it is determined that the vehicle can pass the second traffic light without being stopped at the second traffic light, the second velocity is calculated based on the following fifth relational expression and sixth relational expression, $$t_x=(t_{target}-t_{g1})+t_{m2} \quad \text{Fourth relational expression}$$

$$t_x=(t_{limit}-t_{g1})+t_{m2} \quad \text{Fifth relational expression}$$

$$t_x=L_x/V_2+(V_2-V_o)^2/2aV_2, \quad \text{Sixth relational expression}$$

where $V_2$ is the second velocity, a is constant acceleration, $V_o$ is a velocity when the vehicle passes the first traffic light, $t_x$ is a traveling time taken from the first traffic light to the second traffic light, $t_{g1}$ is a time when the vehicle passes the first traffic light, $t_{target}$ is a time when the second traffic light changes from red to green the next time, $t_{limit}$ is a time when the second traffic light changes from green to red the next time, $t_{m2}$ is a margin for the traveling time $t_x$, and $L_x$ is a traveling distance from the first traffic light to the second traffic light.

12. The traveling assistant system for the vehicle without the contact wire according to claim 2, wherein when calculating a velocity pattern in an interval between the last traffic light of the plurality of traffic lights and the next station, the velocity pattern calculation means calculates a velocity pattern which satisfies conditions that the vehicle is decelerated at an constant acceleration before the vehicle arrives at the next station, and that before decelerating, the vehicle travels constantly at a third velocity when the vehicle passes the last traffic light, wherein the third velocity is calculated based on a traveling time taken from the last traffic light to the next station calculated considering the traveling schedule information, a traveling distance from the last traffic light to the next station, and the constant acceleration.

13. The traveling assistant system for the vehicle without the contact wire according to claim 3, wherein when calculating a velocity pattern in an interval between the last traffic light of the plurality of traffic lights and the next station, the velocity pattern calculation means calculates a velocity pattern which satisfies conditions that the vehicle is decelerated at an constant acceleration before the vehicle arrives at the next station, and that before decelerating, the vehicle travels constantly at a third velocity when the vehicle passes the last traffic light, wherein the third velocity is calculated based on a traveling time taken from the last traffic light to the next station calculated considering the traveling schedule information, a traveling distance from the last traffic light to the next station, and the constant acceleration.

14. The traveling assistant system for the vehicle without the contact wire according to claim 4, wherein when calculating a velocity pattern in an interval between the last traffic light of the plurality of traffic lights and the next station, the velocity pattern calculation means calculates a velocity pattern which satisfies conditions that the vehicle is decelerated at an constant acceleration before the vehicle arrives at the next station, and that before decelerating, the vehicle travels constantly at a third velocity when the vehicle passes the last traffic light, wherein the third velocity is calculated based on a traveling time taken from the last traffic light to the next station calculated considering the traveling schedule information, a traveling distance from the last traffic light to the next station, and the constant acceleration.

15. The traveling assistant system for the vehicle without the contact wire according to claim 10, wherein when calculating a velocity pattern in an interval between the last traffic light of the plurality of traffic lights and the next station, the velocity pattern calculation means calculates a velocity pattern which satisfies conditions that the vehicle is decelerated at an constant acceleration before the vehicle arrives at the next station, and that before decelerating, the vehicle travels constantly at a third velocity when the vehicle passes the last traffic light, wherein the third velocity is calculated based on a traveling time taken from the last traffic light to the next station calculated considering the traveling schedule information, a traveling distance from the last traffic light to the next station, and the constant acceleration.

16. The traveling assistant system for the vehicle without the contact wire according to claim 11, wherein when calculating a velocity pattern in an interval between the last traffic light of the plurality of traffic lights and the next station, the velocity pattern calculation means calculates a velocity pattern which satisfies conditions that the vehicle is decelerated at an constant acceleration before the vehicle arrives at the next station, and that before decelerating, the vehicle travels constantly at a third velocity when the vehicle passes the last traffic light, wherein the third velocity is calculated based on a traveling time taken from the last traffic light to the next station calculated considering the traveling schedule information, a traveling distance from the last traffic light to the next station, and the constant acceleration.

17. The traveling assistant system for the vehicle without the contact wire according to claim 12, wherein the third velocity is calculated based on the following seventh relational expression and eighth relational expression, $$t_y=(t_g-t_{g2})+t_{m3} \quad \text{Seventh relational expression}$$

$$t_y=L_y/V_3+V_3/2a, \quad \text{Eighth relational expression}$$

where $V_3$ is the third velocity, a is constant acceleration, $t_y$ is a traveling time taken from the last traffic light to the next station, $t_g$ is an arrival time at the next station, $t_{g2}$ is a time when the vehicle passes the last traffic light, $t_{m3}$ is a margin for the traveling time $t_y$, and $L_y$ is a traveling distance from the last traffic light to the next station.

18. The traveling assistant system for the vehicle without the contact wire according to claim 13, wherein the third velocity is calculated based on the following seventh relational expression and eighth relational expression, $$t_y=(t_g-t_{g2})+t_{m3} \quad \text{Seventh relational expression}$$

$$t_y=L_y/V_3+V_3/2a, \quad \text{Eighth relational expression}$$

where $V_3$ is the third velocity, a is constant acceleration, $t_y$ is a traveling time taken from the last traffic light to the next station, $t_g$ is an arrival time at the next station, $t_{g2}$ is a time when the vehicle passes the last traffic light, $t_{m3}$ is a margin for the traveling time $t_y$, and $L_y$ is a traveling distance from the last traffic light to the next station.

19. The traveling assistant system for the vehicle without the contact wire according to claim 14, wherein the third velocity is calculated based on the following seventh relational expression and eighth relational expression, $$t_y=(t_g-t_{g2})+t_{m3} \quad \text{Seventh relational expression}$$

$$t_y=L_y/V_3+V_3/2a, \quad \text{Eighth relational expression}$$

where $V_3$ is the third velocity, a is constant acceleration, $t_y$ is a traveling time taken from the last traffic light to the next station, $t_g$ is an arrival time at the next station, $t_{g2}$ is a time when the vehicle passes the last traffic light, $t_{m3}$ is a margin for the traveling time $t_y$, and $L_y$ is a traveling distance from the last traffic light to the next station.

20. A traveling assistant system for a vehicle without a contact wire, the traveling assistant system being configured to calculate a velocity pattern in a traveling interval from a current stop station to a next station, the traveling assistant system comprising:

a memory means which previously stores traveling schedule information of the vehicle and information on a next station located on the traveling interval; and a velocity pattern calculation means which calculates a velocity pattern of the vehicle based on the traveling schedule information and the information on the next station, wherein when calculating a velocity pattern in an interval between the current stop station and the next station, the velocity pattern calculation means calculates a velocity pattern which satisfies conditions that when the vehicle departs from the current stop station and when the vehicle arrives at the next station, the vehicle is accelerated or decelerated at an constant acceleration, and that the vehicle travels at a constant fourth velocity between acceleration and deceleration, and wherein the fourth velocity is calculated based on a traveling time taken from the current stop station to the next station calculated considering the traveling schedule information, a traveling distance from the current stop station to the next station, and the constant acceleration.

* * * * *